US009221656B2

(12) United States Patent
Codd

(10) Patent No.: US 9,221,656 B2
(45) Date of Patent: Dec. 29, 2015

(54) BRAKING SYSTEMS FOR PNEUMATIC HOISTS

(71) Applicant: Ingersoll-Rand Company, Davidson, NC (US)

(72) Inventor: Paul M. Codd, Seattle, WA (US)

(73) Assignee: Ingersoll-Rand Company, Davidson, NC (US)

( * ) Notice: Subject to any disclaimer, the term of this patent is extended or adjusted under 35 U.S.C. 154(b) by 225 days.

(21) Appl. No.: 13/961,465

(22) Filed: Aug. 7, 2013

(65) Prior Publication Data

US 2015/0041740 A1 Feb. 12, 2015

(51) Int. Cl.

| | |
|---|---|
| ***B66D 1/48*** | (2006.01) |
| ***B66D 1/50*** | (2006.01) |
| ***B66D 1/56*** | (2006.01) |
| ***B66D 1/08*** | (2006.01) |
| ***B66D 5/26*** | (2006.01) |
| ***B66D 5/24*** | (2006.01) |

(52) U.S. Cl.

CPC .. *B66D 1/56* (2013.01); *B66D 1/08* (2013.01); *B66D 1/48* (2013.01); *B66D 5/24* (2013.01); *B66D 5/26* (2013.01)

(58) Field of Classification Search

CPC ..... B66D 1/08; B66D 1/48; B66D 1/56; B66D 3/24; B66D 3/26; B66D 5/04; B66D 5/08; B66D 5/26

USPC ..... 254/267, 273, 274

See application file for complete search history.

(56) References Cited

U.S. PATENT DOCUMENTS

| | | | | |
|---|---|---|---|---|
| 2,123,219 | A * | 7/1938 | Waseige | 60/709 |
| 3,251,435 | A * | 5/1966 | Fisher | 182/142 |
| 3,780,989 | A | 12/1973 | Peterson | |
| 3,799,005 | A | 3/1974 | Koehler | |
| 3,801,071 | A | 4/1974 | Barron | |

(Continued)

FOREIGN PATENT DOCUMENTS

| | | | |
|---|---|---|---|
| CN | 202273672 | U | 6/2012 |
| DE | 1148722 | B | 5/1963 |

(Continued)

OTHER PUBLICATIONS

Tiley et al., Abstract to "Trends in Automatic Hoist Controls," Transactions of the American Institute of Electrical Engineers, Part II: Applications and Industry, Jan. 1959, 2 pages.

(Continued)

*Primary Examiner* — Emmanuel M Marcelo

(74) *Attorney, Agent, or Firm* — Barnes & Thornburg LLP

(57) ABSTRACT

Illustrative embodiments of apparatus and methods for braking a hoist system are disclosed. In one illustrative embodiment, a hoist system includes a winch drum and an air motor coupled to the winch drum. The hoist system further includes a brake coupled to the winch drum and operable to stop rotation of the winch drum and an over-speed sensing device configured to sense a speed of the winch drum. The over-speed sensing device includes a pneumatic switch operable to disconnect an air supply from the air motor and engage the brake to stop rotation of the winch drum and a centrifugal clutch coupled to the winch drum and configured to rotate at a rotational speed proportional to the speed of the winch drum. The centrifugal clutch operates the pneumatic switch when the rotational speed of the centrifugal clutch reaches or exceeds a threshold rotational speed.

20 Claims, 5 Drawing Sheets

(56) References Cited

U.S. PATENT DOCUMENTS

| | | | | |
|---|---|---|---|---|
| 4,187,681 | A | 2/1980 | Johnson | |
| 4,196,889 | A | 4/1980 | Dudek | |
| 4,216,848 | A | 8/1980 | Shimodaira | |
| 4,461,460 | A | 7/1984 | Telford | |
| 4,493,479 | A * | 1/1985 | Clark | 254/274 |
| 4,545,567 | A | 10/1985 | Telford et al. | |
| 4,552,340 | A | 11/1985 | Sheppard | |
| 4,886,174 | A | 12/1989 | Leveugle | |
| 5,415,379 | A | 5/1995 | Hoyt et al. | |
| 6,247,570 | B1 | 6/2001 | Zindler | |
| 6,857,515 | B2 | 2/2005 | Barron et al. | |
| 7,448,597 | B2 * | 11/2008 | Jacobson et al. | 254/274 |
| 8,128,067 | B2 | 3/2012 | Terry et al. | |
| 8,409,054 | B2 | 4/2013 | Lin | |
| 2005/0161655 | A1 | 7/2005 | Copp et al. | |
| 2010/0147588 | A1 | 6/2010 | Terry et al. | |
| 2010/0224117 | A1 | 9/2010 | Christensen et al. | |

FOREIGN PATENT DOCUMENTS

| | | | |
|---|---|---|---|
| JP | S56136793 | A | 10/1981 |
| JP | H0940375 | A | 2/1997 |
| WO | 2012019921 | A1 | 2/2012 |

OTHER PUBLICATIONS

Ingersoll-Rand Co., "Product Information: Liftstar and Pullstar Air Winch Models," 2013, 12 pages.

IEC Dusterloh PVT. Ltd., "Air Winches," available at http://www.iecdusterloh.com/air_winches.html, 4 pages.

European Patent Office, International Search Report for PCT/US2014/048817, Nov. 7, 2014 (4 pages).

European Patent Office, Written Opinion of the International Searching Authority for PCT/US2014/048817, Nov. 7, 2014 (6 pages).

* cited by examiner

BRAKING SYSTEMS FOR PNEUMATIC HOISTS

TECHNICAL FIELD

The present disclosure relates, generally, to pneumatic hoists and, more particularly, to braking systems for pneumatic hoists.

BACKGROUND

Pneumatic hoists are well established as a standard in lifting and lowering loads, for example, materials, workpieces, and/or persons. An example of a pneumatic hoist is an air winch, which is a pneumatically powered device that is used for lifting and lowering of loads via a rope or chain that wraps and unwraps around a drum. Such pneumatic hoists are used to move materials, workpieces, and/or persons about a factory or industrial site. When lifting and lowering, braking systems can help prevent injury or death to the persons being lifted and/or lowered and to persons, structures, and/or materials in the area of the pneumatic hoist. One such braking system includes an emergency stop button operated by personnel to brake the winch drum when operating personnel sense a dangerous condition.

SUMMARY

According to one aspect, a hoist system for lifting and lowering loads includes a winch drum configured to rotate to wind and unwind a length of cable and an air motor coupled to the winch drum and operable to rotate the winch drum. The hoist system further includes a brake coupled to the winch drum and operable to stop rotation of the winch drum and an over-speed sensing device configured to sense a speed of the winch drum. The over-speed sensing device includes a pneumatic switch operable to disconnect an air supply from the air motor and engage the brake to stop rotation of the winch drum and a centrifugal clutch coupled to the winch drum and configured to rotate at a rotational speed proportional to the speed of the winch drum. The clutch operates the pneumatic switch when the rotational speed of the centrifugal clutch reaches or exceeds a threshold rotational speed.

In some embodiments, the over-speed sensing device further includes an over-speed detector including an input shaft having a first end coupled to the centrifugal clutch.

In some embodiments, a portion of a second end of the input shaft is positioned to rotate with a portion of the winch drum.

In some embodiments, the portion of the second end of the input shaft comprises a wheel that is positioned adjacent a portion of the winch drum.

In some embodiments, the input shaft includes a keyed feature that interacts with a keyed feature of the centrifugal clutch to cause rotation of the centrifugal clutch.

In some embodiments, the system includes a plate that is rotatable against a spring bias into a position that rotates the over-speed detector out of engagement with the winch drum.

In some embodiments, the threshold rotational speed is between about 1125 and about 1150 rotations per minute.

In some embodiments, an actuator extends from a housing of the centrifugal clutch and rotates with the housing of the centrifugal clutch to operate the pneumatic switch when the threshold rotational speed is reached or exceeded.

According to another aspect, a hoist system for lifting and lowering loads includes a winch drum configured to rotate to wind and unwind a length of cable and an air motor coupled to the winch drum and operable to rotate the drum. The system further includes a brake coupled to the winch drum and operable to stop rotation of the winch drum and an over-speed sensing device configured to sense a speed of the winch drum. The over-speed sensing device includes a pneumatic switch operable to disconnect an air supply from the air motor and to engage the brake to stop rotation of the winch drum and a centrifugal clutch coupled to the winch drum and configured to rotate at a rotational speed proportional to the speed of the winch drum. The centrifugal clutch includes a mass biased toward a central hub of the centrifugal clutch and movable to a position away from the central hub to operate the pneumatic switch when the rotational speed of the centrifugal clutch reaches or exceeds a threshold rotational speed.

In some embodiments, the over-speed sensing device includes an over-speed detector including an input shaft having a first end coupled to the centrifugal clutch.

In some embodiments, a wheel extends from a second end of the input shaft and the wheel is positioned to rotate with a portion of the winch drum.

In some embodiments, the input shaft includes a keyed feature that interacts with a keyed feature of the centrifugal clutch to cause rotation of the centrifugal clutch.

In some embodiments, the system includes a plate that is rotatable against a spring bias into a position that rotates the over-speed detector out of engagement with the winch drum.

In some embodiments, the threshold rotational speed is between about 1125 and about 1150 rotations per minute.

In some embodiments, the system includes an emergency brake button for manually stopping rotation of the winch drum.

According to a further aspect, a method of braking a winch drum of a hoist system including a winch drum is configured to rotate to wind and unwind a length of cable, an air motor being coupled to the winch drum to rotate the drum, and a brake coupled to the drum to stop rotation of the drum, is disclosed. The method comprises the steps of positioning a first end of a rotatable input shaft adjacent a portion of the winch drum such that rotation of the winch drum is transferred to the input shaft and positioning a second end of the rotatable input shaft in engagement with a centrifugal clutch. The method further includes the step of engaging the centrifugal clutch and, thereby, activating a pneumatic switch operable to disconnect an air supply from the air motor and to engage the brake to stop rotation of the winch drum.

In some embodiments, engaging the centrifugal clutch comprises transferring rotational motion from the input shaft to the centrifugal clutch such that a mass of the centrifugal clutch that is biased toward a central hub of the centrifugal clutch moves to a position away from the central hub when a rotational speed of the centrifugal clutch reaches or exceeds a threshold rotational speed.

In some embodiments, engaging the centrifugal clutch further comprises engaging a housing of the centrifugal clutch with a shoe of the centrifugal clutch, when the mass moves to the position away from the central hub, thereby rotating the housing and moving an actuator attached to the housing into engagement with the pneumatic switch.

In some embodiments, the threshold rotational speed is between about 1125 rotations per minute and about 1150 rotations per minute.

In some embodiments, positioning the first end of the rotatable input shaft comprises positioning a wheel at the first end of the rotatable input shaft adjacent a flange of the winch drum, such that the flange of the winch drum causes the wheel to rotate at a speed proportional to a speed of the winch drum.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. The detailed description particularly refers to the accompanying figures in which.

DETAILED DESCRIPTION OF THE DRAWINGS

Figure 1:
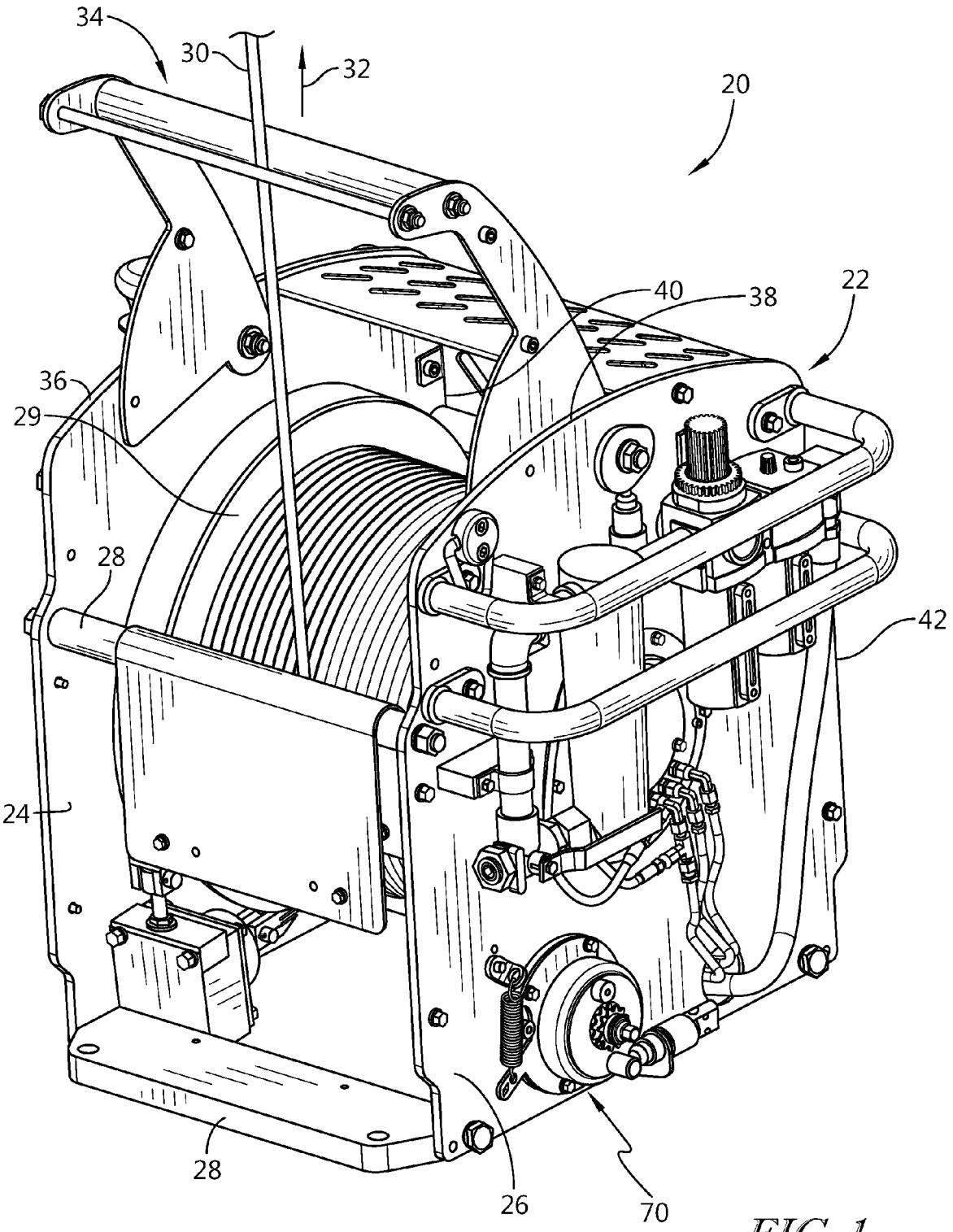
FIG. 1 illustrates a top perspective view of a pneumatically operated hoist system for lifting, lowering, and supporting a load.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Referring now to FIG. 1, a pneumatically operated hoist system 20 for supporting a load, for example, materials, workpieces, and/or persons, is depicted. The hoist system 20 includes a frame 22 having opposing walls 24, 26 and supports 28 extending between and connecting the walls 24, 26. The frame 22 may be supported, for example, on a floor or a deck. A pneumatically operated winch drum 29 extends between the opposing walls 24, 26 and a cable 30 is attached to and wound around the drum 29. The cable 30 may be a cable, chain rope, cord, or any suitable length of material that is capable of winding and unwinding. In illustrative embodiments, the drum 29 may be configured to rotate, for example, in a counterclockwise direction, to wind the cable 30 and, in a clockwise direction, to unwind the cable 30. As seen in FIG. 1, the cable 30 includes a payout direction indicated by arrow 32, wherein the payout direction 32 may be generally vertical. A slack line detection system 34 may be positioned between top edges 36, 38 of the opposing walls 24, 26, respectively. The slack line detection system 34 provides a guide for the cable 30 to position and direct the cable 30 in the proper direction (i.e., vertically, as shown in FIG. 1).

While the payout direction 32 of the cable 30 is shown as being vertical, in illustrative embodiments, the payout direction 32 may be horizontal. In such illustrative embodiments, the slack line detection system 34 would extend between side edges 40, 42 of the walls 24, 26, respectively, to guide the cable 30 in a horizontal direction.

As further seen in FIG. 1, an air motor system (not shown) is operatively connected to the drum 29 and is known in the art. The air motor system may generally include a source of compressed air, a filter regulator and a lubricator for the source of compressed air, and/or other components necessary for the operation of the source of compressed air and the drum 29, and as are known in the art. The air motor system is operatively connected to the drum 29 to rotate the drum 29, thereby winding and unwinding the cable 30. While the principles of the present disclosure are shown as being associated with a particular hoist system 20, the principles disclosed herein may be implemented within any pneumatically-operated hoist system.

Figure 2:
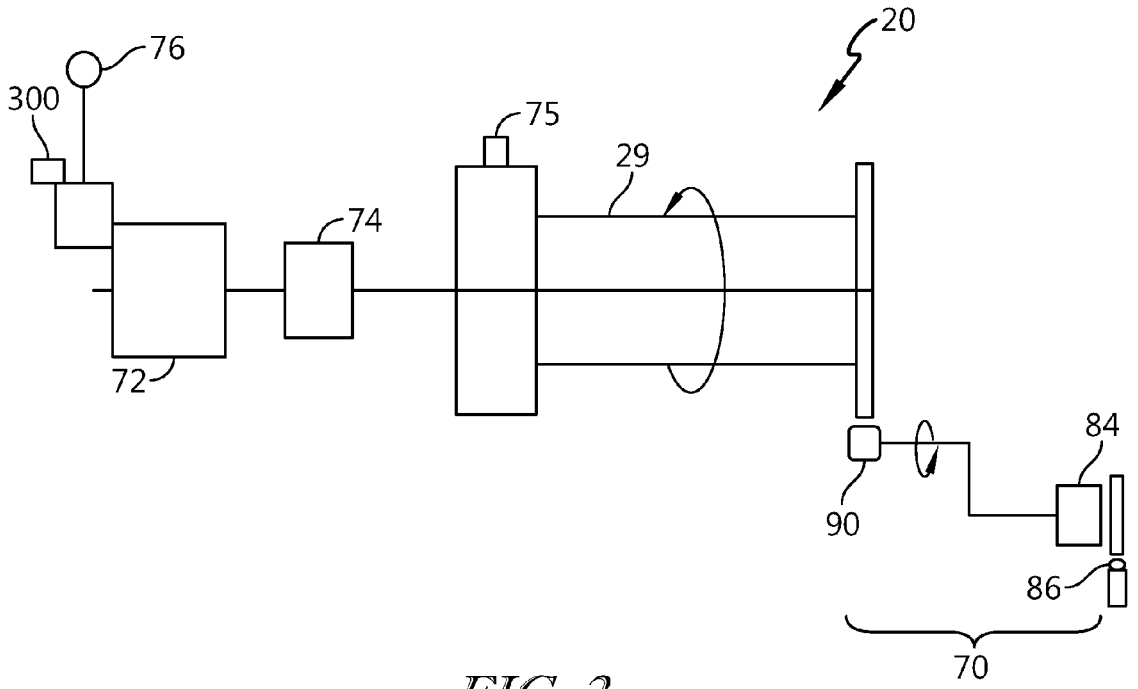
FIG. 2 illustrates a schematic view of an over-speed sensing device for detecting an over-speed condition in, for example, the hoist system of FIG. 1.

Referring to FIG. 2, the air motor system generally includes an air motor 72 operatively connected to the winch drum 29 to provide rotation for operation of the drum 29. A disc brake 74, a band brake 75, and/or any other suitable braking mechanism may be operatively connected to the winch drum 29 to slow rotation of the drum 29. A directional control lever 76 may be operatively connected to the air motor to change a direction of rotation of the drum 29 to lift or lower loads.

Figure 3:
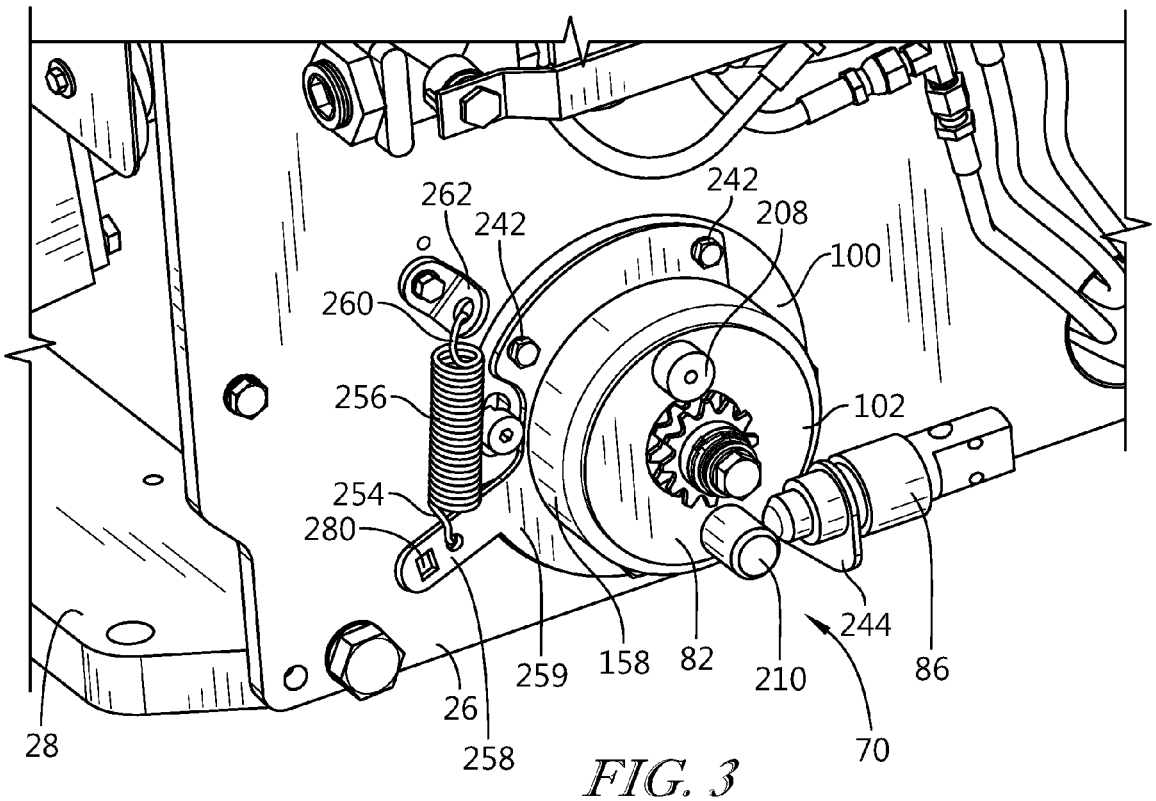
FIG. 3 illustrates a front perspective view of the over-speed sensing device depicted schematically in FIG. 2 and shown in FIG. 1.
Figure 4:
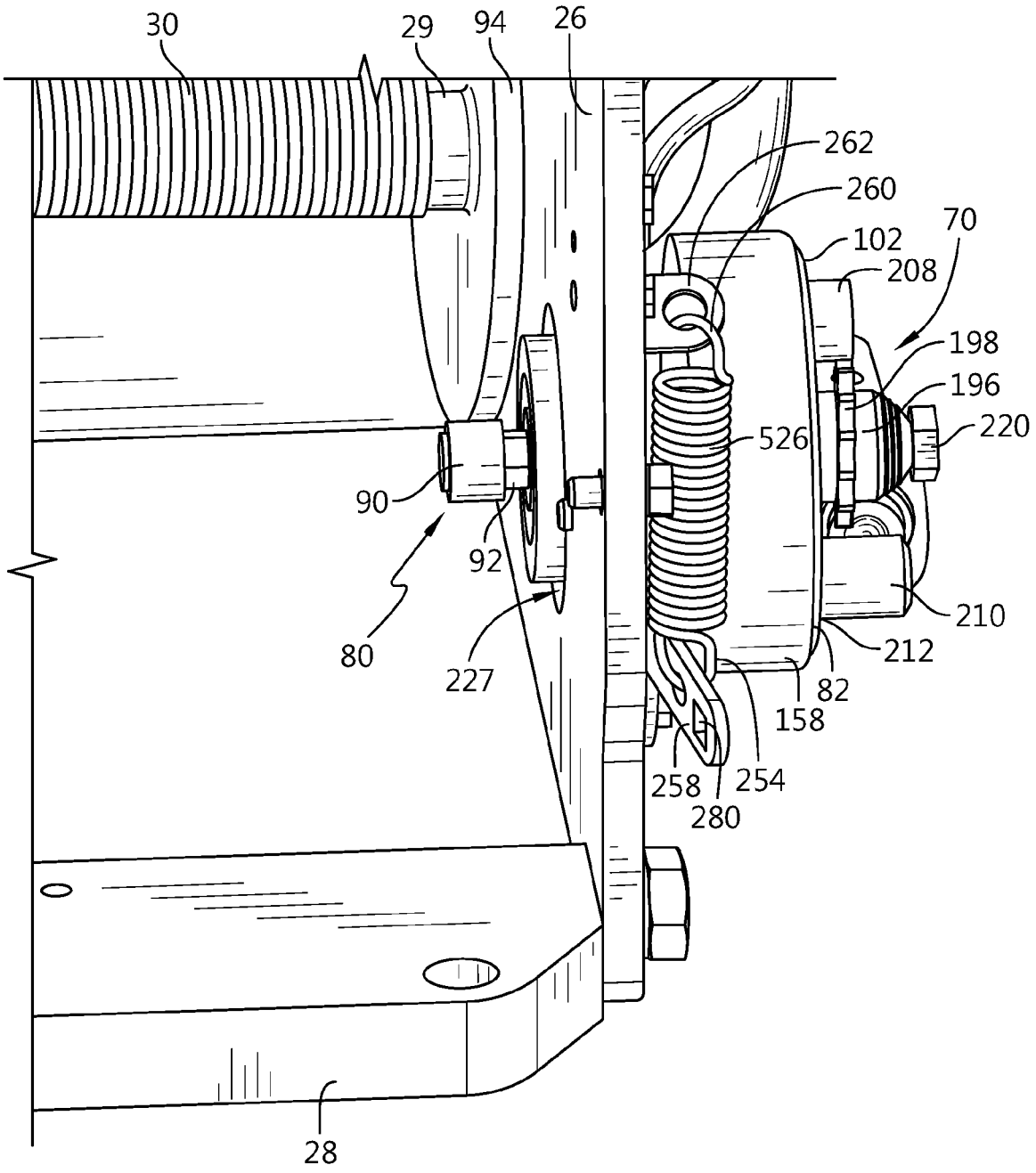
FIG. 4 illustrates a side perspective view of the over-speed sensing device of FIG. 3.

An over-speed sensing device 70 is also schematically depicted in FIG. 2. In an illustrative embodiment, the over-speed sensing device 70 may be located within the wall 26 of the frame 22 of the hoist system 20, as seen in FIGS. 1, 3, and 4. In alternative illustrative embodiments, the over-speed sensing device 70 may be located within the wall 24 or in any location suitable to perform the functions disclosed herein.

Referring to FIGS. 2-5, the over-speed sensing device 70 generally includes an over-speed detector 80, a housing 82, a centrifugal clutch 84, and a switch 86. In illustrative embodiments, the over-speed detector 80 may include a wheel 90 that is operatively connected to an input shaft 92 by a screw, a bolt, or any other suitable connector. Alternatively, the wheel 90 may be integral with the input shaft 92. In illustrative embodiments, the wheel 90 may be positioned to ride along a flange 94 of the drum 29. Optionally, the wheel 90 (or a portion of the shaft 92) may be positioned to ride along any suitable portion of the drum 29. In illustrative embodiments, as discussed in greater detail hereinbelow, the wheel 90 is disposed adjacent the flange 94 such that rotational movement of the drum 29 is translated to the wheel 90 through the flange 94. Rotation of the wheel 90 rotates the input shaft 92 at a speed that is proportional to the speed of the drum 29, which rotates the centrifugal clutch 84, as described in detail below.

Figure 5:
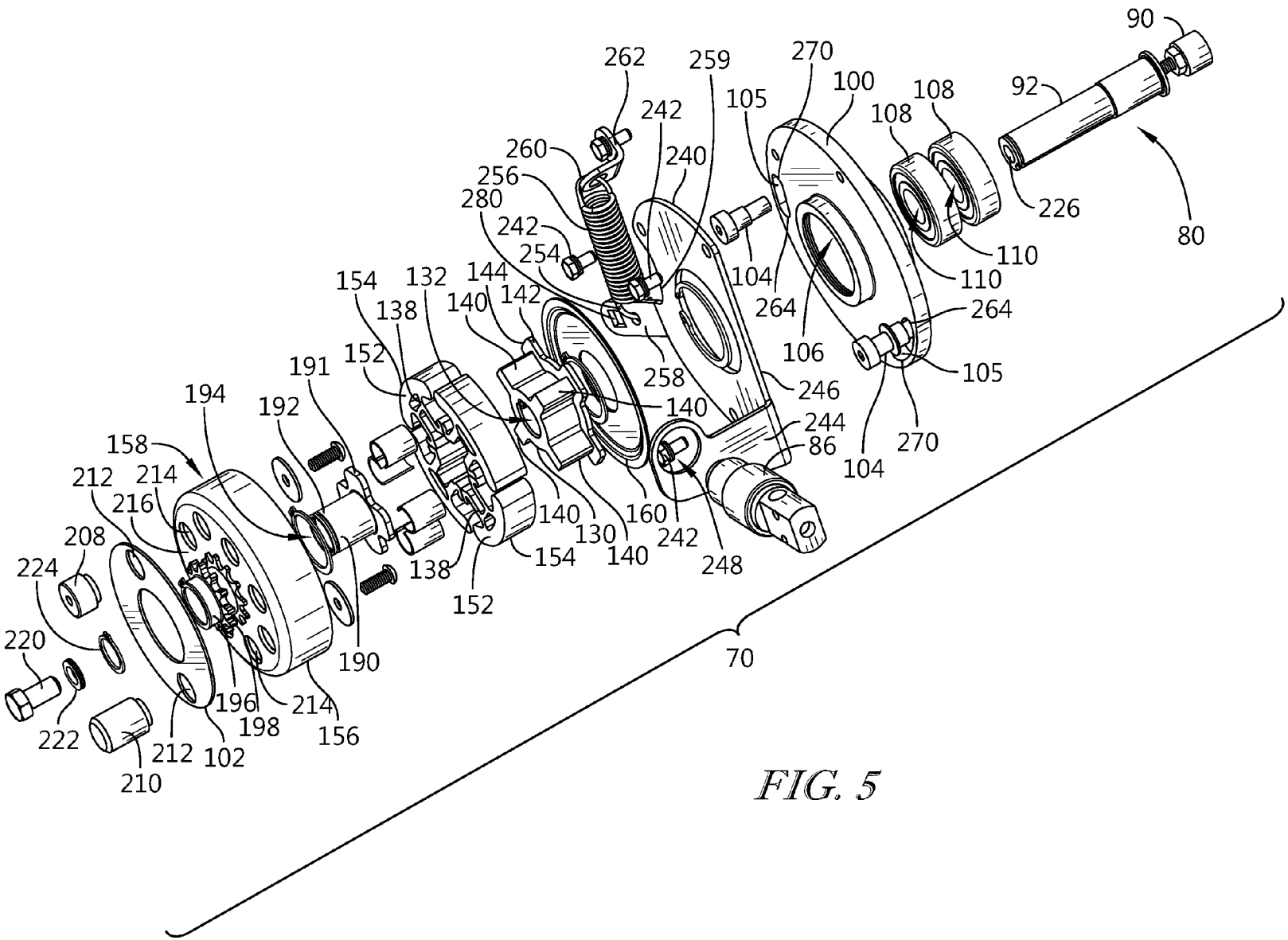
FIG. 5 is an exploded view of the over-speed sensing device of FIG. 3.

As best seen in FIG. 5, the housing 82 includes a rear housing wall 100 and a housing cover 102 that generally enclose the components of the over-speed sensing device 70. The rear housing wall 100 is attached to the wall 26 of the frame 22 by any suitable number of pegs 104 or other suitable fasteners. The pegs 104 extend through arcuate channels 105 in the rear housing wall 100 and through apertures in the wall 26, wherein the arcuate channels 105 allow slight rotation of the rear housing wall 100 with respect to the wall 26 of the frame 22, as will be discussed in greater detail below. A channel 106 is formed through a central portion of the rear housing wall 100 and two positioning elements 108 are disposed within the channel 106. The positioning elements 108 may be positioned within the channel 106 by an interference fit, a friction fit, or any other suitable means. Bores 110 are formed through the positioning elements 108, wherein the bores 110 have a diameter that is slightly greater than a diameter of the input shaft 92. In this manner, the bores 110 in the positioning elements 108 function to position the input shaft 92 such that the wheel 90 is in contact with the flange 94 of the drum 29.

Figure 6:
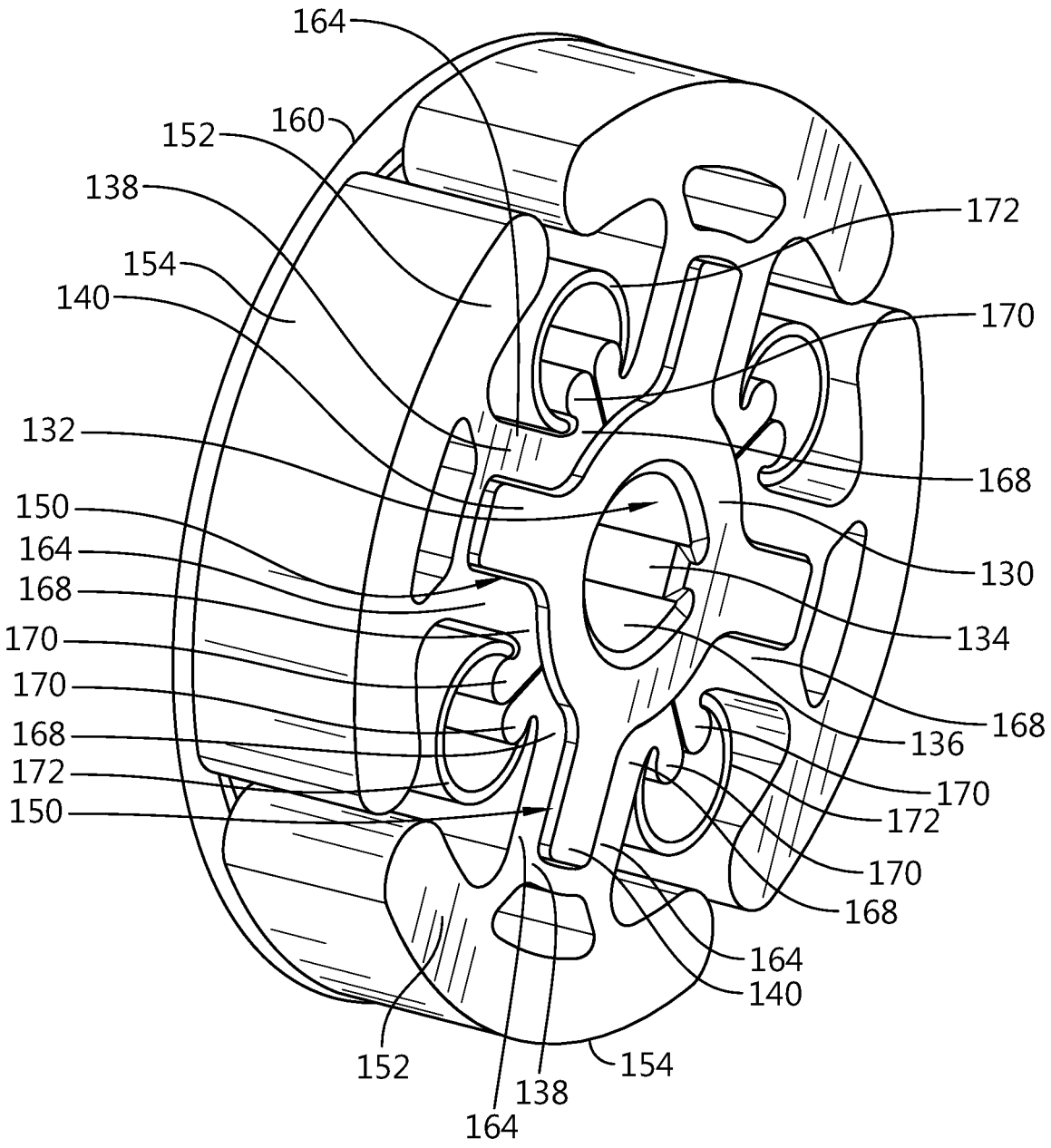
FIG. 6 is a perspective view of portions of a centrifugal clutch of the over-speed sensing device of FIG. 3.

Referring to FIGS. 5 and 6, the centrifugal clutch 84 includes a hub 130 that may be annular and includes a central bore 132 therethrough, wherein the central bore 132 may be cylindrical in shape. The bore 132 permits the hub 130 to be mounted on the input shaft 92, which transmits rotational motion from the drum 29 to the hub 130, as will be discussed in greater detail hereinafter. A locking member or other keyed feature 134, may extend inwardly from a peripheral surface 136 of the bore 132, as best seen in FIG. 6, and may be adapted to mate with a corresponding slot or keyway formed on the input shaft 92 to cause the hub 130 to rotate with the input shaft 92. In alternative illustrative embodiments, any suitable keyed features may be used to cause the centrifugal clutch 84 to rotate with the input shaft 92.

The hub 130 includes a drive mechanism for engaging the hub 130 with one or more clutch shoes 138, as will be discussed in more detail below. The drive mechanism may include a plurality of teeth 140 that extend radially outwardly from the hub 130. The teeth 140 may be attached to a flange 142 formed on an end of the hub 130, wherein the flange 142 acts to retain the clutch shoes 138 on the hub 130. A peripheral edge 144 of the flange may have a curvilinear shape with projections adjacent the teeth 140. The flange 142 is adapted to prevent the shoes from moving axially past the ends of the hub 130, while leaving areas between the teeth 140 relatively open for access and ventilation. While only some of the clutch shoes 138 and the features thereof are labeled in some of the drawings for clarity, the clutch 84 is depicted as including four clutch shoes 138 that include identical features. In other illustrative embodiments, the clutch 84 may include any suitable number of clutch shoes 138.

The clutch shoes 138 are slidably seated on each of the teeth 140 and include a tapered recess 150 in which a respective tooth 140 is positioned. A radial depth of each recess may be sized such that when each clutch shoe 138 is seated on a tooth 140, the clutch shoe 138 contacts the hub 130. As best seen in FIG. 6, each clutch shoe 138 includes a drum contacting body 152, which includes an arcuate outer friction surface 154. Each arcuate outer friction surface 154 may be sized and shaped to conform to an inner peripheral surface of a side wall 156 of a clutch housing cover 158 that encloses the centrifugal clutch 84 together with a clutch housing rear wall 160, as seen in FIG. 5.

The drum contacting body 152 is attached to or formed integrally with a support, which may include two radially extending arms 164 that diverge from one another. Two spring attachment mounts are formed at opposite ends of the arms 164. Each spring attachment mount may include a leg 168 that extends laterally from the support 162 and a retention lip 170 with a bulbous end portion that is designed to retain an end of a spring 172 with an adjacent retention lip 170. The spring 172 may be formed of a C-shaped clip.

Still referring to FIGS. 3-5, a bushing 190 is located adjacent a side of the hub 130 opposite the flange 142. The bushing 190 includes a flat radial flange 191 that contacts ends of the teeth 140 and a cylindrical base portion 192. The bushing 190 includes a central bore 194 that is similar in size and shape to the bore 132 of the hub 130. A keyed feature is formed in the bushing 190 in a manner similar to the keyed feature 134 of the hub 130, as described above. When the clutch 84 is assembled, the bushing 190 extends through and is held in place by the housing cover 158 and a sleeve 196 may be rotatably disposed about the bushing 190. The sleeve 196 may include a sprocket 198 that serves as a power output from the clutch 84.

The centrifugal clutch 84 is commercially available from The Hilliard Corporation under the product name "Extreme Duty Centrifugal Clutch". The centrifugal clutch 84 is described in greater detail in Barron et al. U.S. Pat. No. 6,857,515, issued on Feb. 22, 2005, the disclosure of which is hereby incorporated by reference in its entirety. While a particular centrifugal clutch 84 is depicted and described in detail herein, any suitable centrifugal clutch may alternatively be used.

As best seen in FIG. 5, in illustrative embodiments, a knob 208 and an over-speed actuator 210 extend through peripheral apertures 212 in the housing cover 102 and through corresponding peripheral apertures 214 in a top wall 216 of the clutch housing cover 158. In this manner, the knob 208 and the over-speed actuator 210 capture and retain the housing cover 102 in position. The knob 208 and over-speed actuator 210 are also retained within the clutch housing cover 158 and, thus, rotate with rotation of the clutch housing cover 158 or remain stationary when the clutch housing cover 158 is stationary.

A screw 220 and a washer 222 may be utilized to rotate the over-speed sensing device 70. A retaining ring 224 may be utilized to attach and retain in position the components of the over-speed sensing device 70. When the over-speed sensing device 70 is assembled and attached to the wall 26, the input shaft 92 extends into the frame 22 through an aperture 227 in the wall 26. In addition, the input shaft 92 extends through the positioning elements 108, the rear housing wall 100, the clutch 84, and the housing cover 102. The input shaft 92 may include a keyed feature that is aligned with to the keyed feature 134 of the hub 130 and the keyed feature of the bushing 190 to cause the hub 130 and the bushing 190 to rotate with the input shaft 92.

As best seen in FIGS. 3 and 5, the over-speed sensing device 70 may include a spring biased plate 240 that may be disposed between the clutch housing rear wall 160 and the rear housing wall 100. In alternative illustrative embodiments, the spring biased plate 240 may be disposed in any other suitable location. The plate 240 may be attached to the rear housing wall 100 by any suitable number of fasteners 242, for example, screws. The plate 240 may include an arm 244 on a first side 246 thereof that extends at about 90 degrees with respect to the wall 26 of the frame 22. The switch 86 may be held within an aperture 248 in the arm 244 by an interference, frictional, or other suitable fit.

A first end 254 of a spring 256 may be attached to an arm 258 that extends outwardly from the plate 240 on a second side 259 that may be opposite the first side 246 of the plate 240. A second end 260 of the spring 256 may be attached to a bracket 262 or other suitable support that is attached to the wall 26 of the frame 22. The spring 256 biases the plate 240 in a clockwise most position with the pegs 104 positioned within first ends 264 of the channels 105. When the plate 240 is biased in this position, the input shaft 92 and the wheel 90 are positioned with the wheel 90 in contact with the flange 94 of the drum 29. In order to service or test the over-speed sensing device 70 or other components of the hoist system 20, the plate 240 may be manually rotated against the bias of the spring 246 by grasping, for example, one of the arms 244, 258 and rotating the plate 240 in a counterclockwise direction against the bias of the spring 256. The rotation of the plate 240 causes rotation of the rear housing wall 100 about the pegs 104, such that the pegs 104 move through the arcuate channels 105 and stop adjacent second ends 270 of the channels 105. In this manner, rotation of the rear housing wall 100 rotates the input shaft 92 and wheel 90 in a counterclockwise direction out of engagement with the flange 94 of the drum 29. A tool may be inserted into an aperture 280 in the arm 258 to retain the plate 240 in its rotated position against the bias of the spring 256.

The function of the over-speed sensing device 70 will now be described in detail with references to the figures. When the springs 172 are mounted on each set of adjacent retention lips 170, and the centrifugal clutch 84 is disengaged, the spring force generated by the springs 172 urges the clutch shoes 138 toward one another. Since the clutch shoes 138 are arranged in a circular pattern, the result is that the springs 172 urge the clutch shoes 138 radially inwardly toward the hub 130. Engagement of the hub 130 begins to occur when the speed of rotation of the hub 130 reaches a threshold rotational speed that is sufficient enough to generate a centrifugal force on the clutch shoes 138 that is greater than the force of the springs 172. The centrifugal force urges the clutch shoes 138 radially outward. The threshold rotational speed of the clutch 84 is determined based on several factors including a mass distribution of the clutch shoes 138 and the force of the springs 172. In illustrative embodiments, this threshold rotational speed of the clutch 84 may be between about 1125 and about 1150 rotations per minute, which equates to a threshold rotational speed of the drum 29 being between about 47 and about 49 rotations per minute, which equates to between about 55 and about 57 meters per minute line (rope or cable) speed.

A frictional force generated by contact between the arcuate outer friction surfaces 154 of the clutch shoes 138 and the inner peripheral surface of the side wall 156 of the clutch housing cover 158 causes the clutch housing cover 158 to rotate with the centrifugal clutch 84. Once the clutch housing cover 158 begins to rotate with the centrifugal clutch 84, the over-speed actuator 210 contacts the switch 86. Actuation of the switch 86 causes the air supply from the air motor to be disconnected from the drum 29, thereby engaging the disc brake 74, band brake 75, or other suitable brake to stop rotation of the drum 29. The over-speed sensing device 70 is therefore able to sense a speed of the drum 29 and stop rotation of the drum 29 when the speed of the drum 29 reaches a threshold rotational speed (and the centrifugal clutch 84 reaches an threshold rotational speed).

The hoist system 20 may include, in addition to the over-speed sensing device 70, an emergency stop or reset button or device 300, as seen in FIG. 2. The emergency stop or reset button or device 300, if present, may be operated by a user at any time, for example, when the user wants to stop the drum 29 prior to reaching the threshold rotational speed at which the over-speed sensing device 70 would operate.

Although directional terminology, such as front, rear, side, clockwise, counterclockwise, etc. may be used throughout the present specification, it should be understood that such terms are not limiting and are only utilized herein to convey the orientation of different elements with respect to one another.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A hoist system for lifting and lowering loads, the hoist system comprising:

a winch drum configured to rotate to wind and unwind a length of cable;

an air motor coupled to the winch drum and operable to rotate the drum;

a brake coupled to the winch drum and operable to stop rotation of the winch drum; and an over-speed sensing device configured to sense a speed of the winch drum, the over-speed sensing device including:

(i) a pneumatic switch operable to disconnect an air supply from the air motor and engage the brake to stop rotation of the winch drum; and (ii) a centrifugal clutch coupled to the winch drum and configured to rotate at a rotational speed proportional to the speed of the winch drum, such that the clutch operates the pneumatic switch when the rotational speed of the centrifugal clutch reaches or exceeds a threshold rotational speed.

2. The hoist system of claim 1, wherein the over-speed sensing device further includes an over-speed detector including an input shaft having a first end coupled to the centrifugal clutch.

3. The hoist system of claim 2, wherein a portion of a second end of the input shaft is positioned to rotate with a portion of the winch drum.

4. The hoist system of claim 3, wherein the portion of the second end of the input shaft comprises a wheel that is positioned adjacent the portion of the winch drum.

5. The hoist system of claim 3, further including a plate that is rotatable against a spring bias into a position that rotates the over-speed detector out of engagement with the winch drum.

6. The hoist system of claim 2, wherein the input shaft includes a keyed feature that interacts with a keyed feature of the centrifugal clutch to cause rotation of the centrifugal clutch.

7. The hoist system of claim 1, wherein the threshold rotational speed is between about 1125 and about 1150 rotations per minute.

8. The hoist system of claim 7, wherein an actuator extends from a housing of the centrifugal clutch and rotates with the housing of the centrifugal clutch to operate the pneumatic switch when the threshold rotational speed is reached or exceeded.

9. A hoist system for lifting and lowering loads, the hoist system comprising:

a winch drum configured to rotate to wind and unwind a length of cable;

an air motor coupled to the winch drum and operable to rotate the drum;

a brake coupled to the winch drum and operable to stop rotation of the winch drum; and an over-speed sensing device configured to sense a speed of the winch drum, the over-speed sensing device including:

(i) a pneumatic switch operable to disconnect an air supply from the air motor and to engage the brake to stop rotation of the winch drum; and (ii) a centrifugal clutch coupled to the winch drum and configured to rotate at a rotational speed proportional to that of the winch drum, the centrifugal clutch including a mass biased toward a central hub of the centrifugal clutch and movable to a position away from the central hub to operate the pneumatic switch when the rotational speed of the centrifugal clutch reaches or exceeds a threshold rotational speed.

10. The hoist system of claim 9, wherein the over-speed sensing device further includes an over-speed detector including an input shaft having a first end coupled to the centrifugal clutch.

11. The hoist system of claim 10, wherein a wheel extends from a second end of the input shaft and the wheel is positioned to rotate with a portion of the winch drum.

12. The hoist system of claim 11, further including a plate that is rotatable against a spring bias into a position that rotates the over-speed detector out of engagement with the winch drum.

13. The hoist system of claim 11, wherein the threshold rotational speed is between about 1125 and about 1150 rotations per minute.

14. The hoist system of claim 10, wherein the input shaft includes a keyed feature that interacts with a keyed feature of the centrifugal clutch to cause rotation of the centrifugal clutch.

15. The hoist system of claim 9, further including an emergency brake button for manually stopping rotation of the winch drum.

16. A method of braking a winch drum of a hoist system, wherein the winch drum is configured to rotate to wind and unwind a length of cable, an air motor being coupled to the winch drum to rotate the drum, and a brake coupled to the drum to stop rotation of the drum, the method comprising:

positioning a first end of a rotatable input shaft adjacent a portion of the winch drum such that rotation of the winch drum is transferred to the input shaft;

positioning a second end of the rotatable input shaft in engagement with a centrifugal clutch; and engaging the centrifugal clutch and, thereby, activating a pneumatic switch operable to disconnect an air supply from the air motor and to engage the brake to stop rotation of the winch drum.

17. The method of braking of claim 16, wherein engaging the centrifugal clutch comprises transferring rotational motion from the input shaft to the centrifugal clutch such that a mass of the centrifugal clutch that is biased toward a central hub of the centrifugal clutch to move to a position away from the central hub when a rotational speed of the centrifugal clutch reaches or exceeds a threshold rotational speed.

18. The method of braking of claim 17, wherein engaging the centrifugal clutch further comprises engaging a housing of the centrifugal clutch with a show of the centrifugal clutch, when the mass moves to a position away from the central hub, thereby rotating the housing and moving an actuator attached to the housing into engagement with the pneumatic switch.

19. The method of braking of claim 17, wherein the threshold rotational speed is between about 1125 rotations per minute and about 1150 rotations per minute.

20. The method of braking of claim 16, wherein positioning the first end of the rotatable input shaft comprises positioning a wheel at the first end of the rotatable input shaft adjacent a flange of the winch drum, such that the flange of the winch drum causes the wheel to rotate at a speed proportional to a speed of the winch drum.

* * * * *